US005365619A

United States Patent [19]

Solomon

[11] Patent Number: 5,365,619

[45] Date of Patent: Nov. 22, 1994

[54] BATHTUB SHIELD ARRANGEMENT

[76] Inventor: Jeff Solomon, 22468 Easterferry Rd., Elkmont, Ala. 35620

[21] Appl. No.: 194,003

[22] Filed: Feb. 9, 1994

[51] Int. Cl.[5] ..... A47K 3/22

[52] U.S. Cl. ..... 4/609

[58] Field of Search ..... 4/608, 609, 610, 558; 160/349.1, 349.2

[56] References Cited

U.S. PATENT DOCUMENTS 1,013,162 1/1912 Hiteshew ..... 4/609
1,791,696 2/1931 Alexander ..... 4/609
3,855,642 12/1974 Blitch .
3,942,197 3/1976 Sudmann et al. .
4,620,332 11/1986 Laird .
4,765,001 8/1988 Smith .
4,888,835 12/1989 Baumann .

*Primary Examiner*—Charles E. Phillips

[57] ABSTRACT

A shield member is arranged for mounting onto the sidewall portion of a bathtub, wherein the shield member includes a splash guard plate pivotally mounted to the shield member to permit securement of the splash guard plate to the wall surfaces of the surrounding bathroom in a raised orientation.

6 Claims, 2 Drawing Sheets

BATHTUB SHIELD ARRANGEMENT

BACKGROUND OF THE INVENTION

1. Field of the Invention The field of invention relates to bathtub shield structure, and more particularly pertains to a new bathtub shield arrangement wherein the same is arranged for mounting to a bathtub to prevent water splashing from within the bathtub during a bathing event.

2. Description of the Prior Art The bathing of children and the like has typically associated therewith splashing relative to such child behavior during a bathing event. The instant invention is arranged to prevent water splashing from the bathtub onto an adjacent floor.

U.S. Pat. Nos. 3,942,197; 3,855,642; 4,620,332; and 4,888,835 are prior art examples of bathtub shield structure.

The instant invention attempts to overcome deficiencies of the prior art by providing for a shield structure arranged for mounting relative to the bathtub and permitting its lowering in a first position during non-use and storage and raising to a second position during a bathing event and in this respect, the present invention substantially fulfills this need.

SUMMARY OF THE INVENTION

In view of the disadvantages inherent in the known types of bathtub shield apparatus now present in the prior art, the present invention provides a bathtub shield arrangement wherein the same includes a pivotally mounted bathtub shield plate arranged for lifting to a raised orientation during a bathing event. As such, the general purpose of the present invention, which will be described subsequently in greater detail, is to provide a new bathtub shield arrangement apparatus and method which has many of the advantages of the prior art listed heretofore and many novel features that result in a bathtub shield arrangement apparatus which is not anticipated, rendered obvious, suggested, or even implied by any of the prior art, either alone or in any combination thereof.

To attain this, the present invention provides a shield member arranged for mounting onto the sidewall portion of a bathtub, wherein the shield member includes a splash guard plate pivotally mounted to the shield member to permit securement of the splash guard plate to the wall surfaces of the surrounding bathroom in a raised orientation.

There has thus been outlined, rather broadly, the more important features of the invention in order that the detailed description thereof that follows may be better understood, and in order that the present contribution to the art may be better appreciated. There are, of course, additional features of the invention that will be described herein after and which will form the subject matter of the claims appended hereto.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bathtub shield arrangement apparatus and method which has many of the advantages of the prior art listed heretofore and many novel features that result in a bathtub shield arrangement apparatus which is not anticipated, rendered obvious, suggested, or even implied by any of the prior art, either alone or in any combination thereof.

It is another object of the present invention to provide a new bathtub shield arrangement which may be easily and efficiently manufactured and marketed.

It is a further object of the present invention to provide a new bathtub shield arrangement which is of a durable and reliable construction.

An even further object of the present invention is to provide a new bathtub shield arrangement which is susceptible of a low cost of manufacture with regard to both materials and labor, and which accordingly is then susceptible of low prices of sale to the consuming public, thereby making such bathtub shield arrangements economically available to the buying public.

Still yet another object of the present invention is to provide a new bathtub shield arrangement which provides in the apparatuses and methods of the prior art some of the advantages thereof, while simultaneously overcoming some of the disadvantages normally associated therewith.

Yet an even further object of the present invention is to provide a new bathtub shield member for mounting onto the sidewall portion of a bathtub, wherein the shield member includes a splash guard plate pivotally mounted to the shield member to permit securement of the splash guard plate to the wall surfaces of the surrounding bathroom in a raised orientation.

These together with other objects of the invention, along with the various features of novelty which characterize the invention, are pointed out with particularity in the claims annexed to and forming a part of this disclosure. For a better understanding of the invention, its operating advantages and the specific objects attained, reference should be had to the accompanying drawings and descriptive matter in which there is illustrated preferred embodiments of the invention.

BRIEF DESCRIPTION OF THE DRAWINGS

The invention will be better understood and objects other than those above will become apparent when consideration is given to the following detailed description thereof. Such description makes reference to the annexed drawings wherein.

DESCRIPTION OF THE PREFERRED EMBODIMENT

Figure 1:
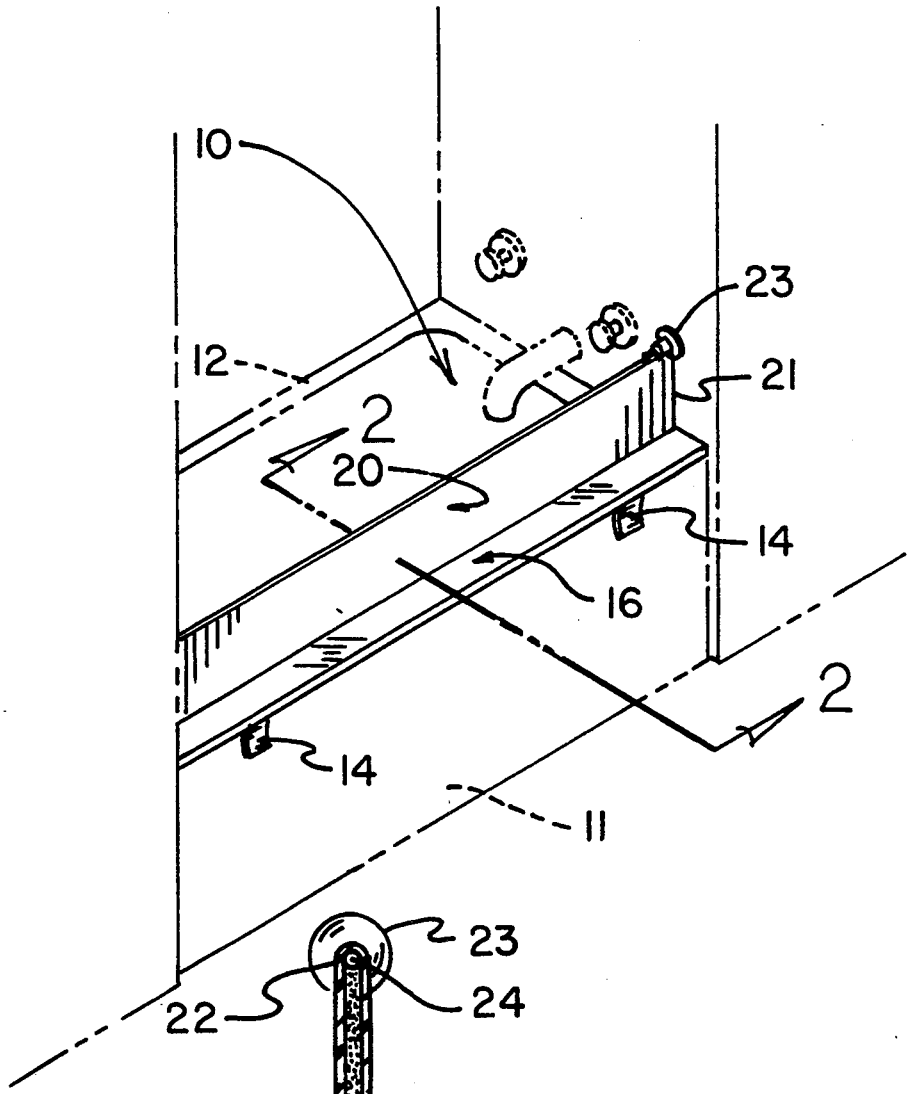
FIG. 1 is an isometric illustration of the invention as installed within a bathtub area.
Figure 2:
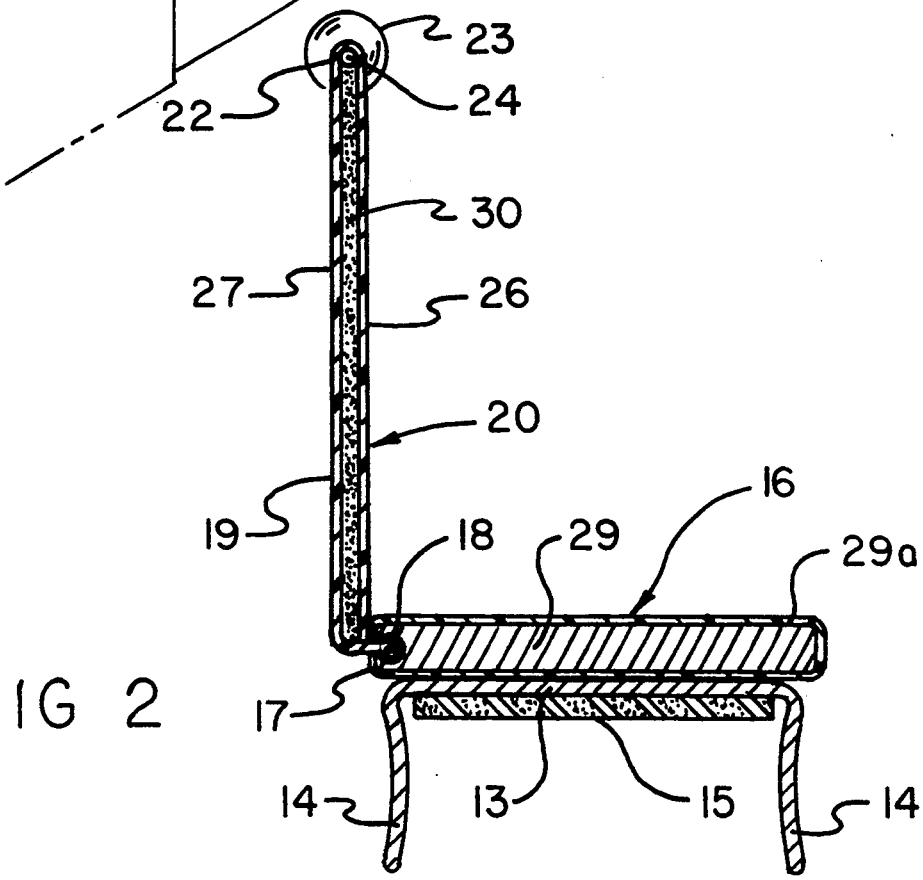
FIG. 2 is a cross sectional view, taken along the lines 2—2 of FIG. 1 in the direction indicated by the arrows.
Figure 3:
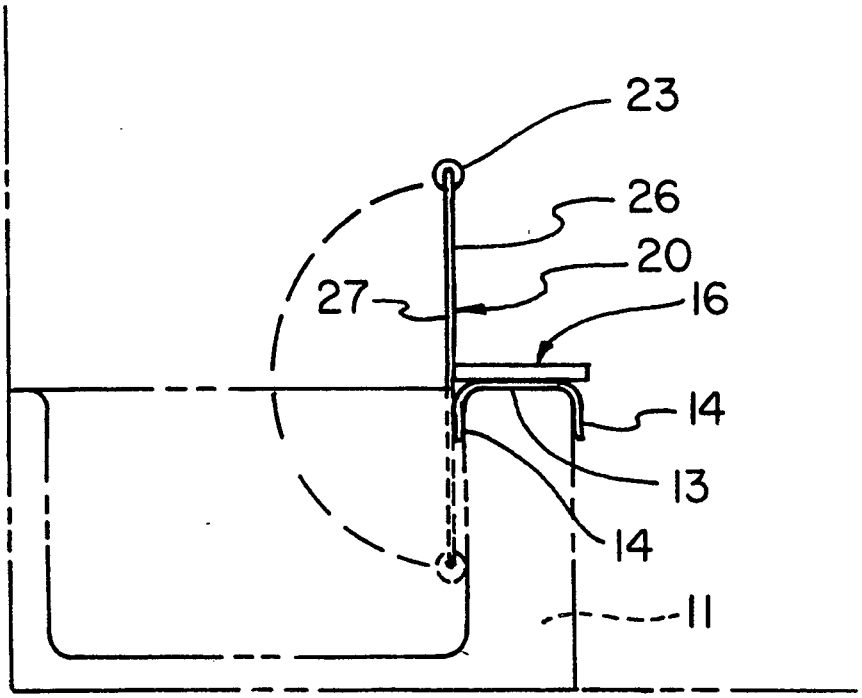
FIG. 3 is an orthographic end view of the invention arranged for lifting from a lowered position to a raised position relative to the bathtub member.

With reference now to the drawings, and in particular to FIGS. 1–3 thereof, a new bathtub shield arrangement embodying the principles and concepts of the present invention and generally designated by the reference numeral 10 will be described.

The bath tub 11 being positioned between two end walls or supports.

More specifically, the bathtub shield arrangement 10 of the instant invention is arranged for mounting to a bathtub 11 having a bathtub top wall 12. The invention 10 comprises at least one mounting plate 13 having pairs of spaced spring legs 14 extending substantially orthogonally and downwardly therefrom. Each leg 14 of each individual respective pair is biased toward one another to engage the side walls of the bathtub adjacent the bathtub top wall 12. A sealing cushion 15 is mounted to a bottom surface of the mounting plate 13, and a support flange 16 is mounted coextensively to the top surface of the mounting plate 13. The support flange may be comprised of a padding material 29 encapsulated by a resilient covering **29*a*** to provide a cushioning surface against which a parent or other person may rest.

The support flange 16 includes a support flange side wall 17 having a hinge 18 operable to pivotally mount a splash guard plate 20 relative to the support flange side wall 17, in a manner as indicated in FIG. 2. A polymeric covering 19 is arranged for optional securement to a foam core 30 of the splash guard plate 20 such that the guard plate will float, or alternatively the splash guard plate 20 itself may be formed of polymeric water impermeable type rigid material which will sink. The splash guard plate 20 is formed with guard plate end walls 21, a top wall tube 22, and spaced first and second side walls 26 and 27. Each end of the top wall tube 22 is directed coextensively to a respective guard plate end wall 21, such that a suction cup 23 having a suction cup rod 24 is received through the top wall tube 22 to further rigidify the structure 10. It has been found that the suction cup is superior to other securement devices because suction cups work particularly well in the wet environment of the bathtub area and do not scratch or mar the surrounding tile or fiberglass.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention.

Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bathtub shield arrangement for use on an edge of a bath tub which is positioned between two end supports, comprising:

a mounting plate, the mounting plate including a mounting plate bottom surface and a mounting plate top surface, with at least one pair of spring legs extending below the bottom surface for engaging sidewalls of an associated bathtub;

a sealing cushion mounted to the bottom surface a support flange mounted to the top surface, with the support flange including a support flange side wall;

a hinge mounted to the support flange side wall;

a splash guard plate mounted to the hinge such that the splash guard plate may assume a lowered position and an upward splash guarding position extending above the tub rim between the two end supports; and, securement means mounted to the splash guard plate for permitting securement of the splash guard plate to the end supports while in said upward orientation.

2. A bathtub shield arrangement as set forth in claim 1, wherein the securement means includes an elongate top wall tube arranged coextensively along an uppermost end of the splash guard plate;

a rod having ends thereof and extending through the top wall tube; and, a plurality of suction cup members, each suction cup member being secured to an individual end of the rod, wherein the splash guard plate includes guard plate end walls, and each said suction cup is positioned adjacent a respective said end wall and projecting beyond said end wall.

3. A bathtub shield arrangement as set forth in claim 2, wherein the support flange is comprised of a padding material encapsulated by a resilient covering to provide cushioning surface against which a person may rest.

4. A bathtub shield arrangement as set forth in claim 3, wherein the splash guard plate is comprised of polymeric covering securement to a foam core.

5. A bathtub shield arrangement as set forth in claim 3, wherein the splash guard plate is comprised of a polymeric, water impermeable, rigid material.

6. A bathtub shield arrangement as set forth in claim 5, wherein the splash guard plate is non-buoyant.

* * * * *